US010196818B1

(12) United States Patent
Martell et al.

(10) Patent No.: US 10,196,818 B1
(45) Date of Patent: Feb. 5, 2019

(54) DEVICE FOR BUILDING CONCRETE ROOFS AND METHOD

(71) Applicants: Olga Martell, Miami, FL (US); Rafael Martell, Miami, FL (US)

(72) Inventors: Olga Martell, Miami, FL (US); Rafael Martell, Miami, FL (US)

( * ) Notice: Subject to any disclaimer, the term of this patent is extended or adjusted under 35 U.S.C. 154(b) by 0 days.

(21) Appl. No.: 15/452,286

(22) Filed: Mar. 7, 2017

(51) Int. Cl.
*E04B 7/02* (2006.01)
*E04B 7/22* (2006.01)
*E04C 3/07* (2006.01)
*E04C 5/06* (2006.01)

(52) U.S. Cl.
CPC ..... *E04C 3/07* (2013.01); *E04B 7/022* (2013.01); *E04B 7/22* (2013.01); *E04C 5/06* (2013.01)

(58) Field of Classification Search
CPC ... E04C 3/07; E04C 5/06; E04C 2/384; E04B 7/022; E04B 7/22; E04B 1/161
See application file for complete search history.

(56) References Cited

U.S. PATENT DOCUMENTS 4,602,467 A * 7/1986 Schilger ..... E04C 2/284 52/319
4,729,201 A * 3/1988 Laurus ..... E04D 13/1476 52/334
4,885,884 A * 12/1989 Schilger ..... E04B 5/04 52/354
5,414,972 A * 5/1995 Ruiz ..... E04B 5/29 52/335
5,758,463 A * 6/1998 Mancini, Jr. ..... E04C 2/384 52/309.12
6,363,674 B1 * 4/2002 Carver ..... E04B 1/14 52/270
7,353,642 B1 4/2008 Henriquez
8,516,762 B1 * 8/2013 Jendusa ..... E04C 3/09 52/220.2
8,857,116 B2 * 10/2014 Henriquez ..... E04B 1/14 52/220.2
2006/0075707 A1 * 4/2006 Cretti ..... E04B 5/026 52/414
2007/0245657 A1 * 10/2007 Valle ..... E04C 3/07 52/356
2009/0205285 A1 * 8/2009 Jendusa ..... E04B 5/263 52/650.3
2011/0036046 A1 * 2/2011 Henriquez ..... E04B 1/161 52/764

(Continued)

*Primary Examiner* — Brian D Mattei
(74) *Attorney, Agent, or Firm* — Sanchelima & Associates, P.A.; Christian Sanchelima; Jesus Sanchelima

(57) ABSTRACT

An apparatus used in roof construction wherein insulation material is held flush within the channels formed by the apparatus. The flush engagement between the insulation material and the walls defining the channels of the apparatus leads to a greater surface area securing the insulating material in place. The apparatus includes attachment means on its top flanges to mount rebar members to the apparatus holding the rebar grid in place. The vertically disposed flanges of the apparatus include openings that allow concrete to pass through the apparatus preventing fatigue points caused by the interruption of concrete. The apparatus can be employed in a method that allows a roof to be transported to a job site with the rebar grid already secured to an apparatus.

2 Claims, 8 Drawing Sheets

(56) References Cited

U.S. PATENT DOCUMENTS

| | | | | |
|---|---|---|---|---|
| 2013/0133284 | A1* | 5/2013 | Powers, III | E04C 3/07<br>52/831 |
| 2014/0298749 | A1* | 10/2014 | Manning | E04B 5/40<br>52/649.2 |

* cited by examiner

DEVICE FOR BUILDING CONCRETE ROOFS AND METHOD

BACKGROUND OF THE INVENTION

1. Field of the Invention

The present invention relates to concrete roofing construction, and, more particularly, to a versatile attachment apparatus for supporting rebar grids and the insulation material and also used as concrete form work.

2. Description of the Related Art

Several building construction methods and structures for concrete roofing have been designed in the past. None of them, however, include an apparatus with a modified C-channel beam that provides a flush cooperation with insulation material allowing for a greater surface area along the C-channel to secure the insulating material in place. In addition, the apparatus is formed to provide attachment means on its top flanges to secure the rebar grid used in the construction of roofs. This feature is not disclosed in the prior art.

Applicant believes that a related reference corresponds to U.S. Pat. No. 7,353,642 B1 issued to Jose Luis Henriquez. However, it differs from the present invention because the apparatus Henriquez discloses a device that only secures the insulating board at two supporting contact points where the board rests. This is due to the nature of its design. The top piece is mounted over the base piece and includes two longitudinal extensions that are used to hold the insulating material. Several problems still exist with Henriquez's design that are solved by the present invention. First, Henriquez relies on extensions to hold the insulation board in place, these extensions create a weak engagement and can pierce through the insulating material. The present device is designed differently by having the entire surface area of the top wall of the channel flush with the insulation board. This type of engagement is more secure and prevents any damage caused to the insulation board due to piercing. Also, the device is one continuous piece as opposed to Henriquez which is made of a top piece mounted over a base piece. By being one piece, the present device is easier to install and not subject to problems relating to the attachment of the base piece to the top piece in Henriquez. Third, Henriquez requires onsite installation of C-channel members. The present device includes a plurality of throughholes along the vertically disposed flange of the rebar attachment assembly that allow transportation rebar members to pass through and be used for transporting sections of the present device fitted with insulation boards.

Fourth, Henriquez does not teach any means for securing the structural rebar to his apparatus. The present invention in the form of a Z-channel provides attachment means between the top rebar attachment flanges of the device and the rebar that makes up the rebar grid used in the concrete roofing. This attachment creates a more secure rebar grid that is prevented from shifting during construction.

Fifth, Henriquez does not teach of creating throughholes in his device to allow concrete to pass through uninterrupted. The present device has a plurality of throughholes along the vertically disposed flange adjacent to the openings for the transportation rebar, thereby creating a secure engagement along the entire concrete and preventing fatigue points in the device.

Another related reference is U.S. Pat. No. 4,885,884 issued to Herbert Schilger on Dec. 12, 1989 directed at a panel for floors or wall but not roofs. Not only is the intended use different but the intended use difference causes critical structural differences between it and the present invention. Namely, the Schilger references doesn't teach or motivate one of ordinary skills in the art to include a cavity extending between the inward flanges of the rebar attachment assembly to secure the rebar members. The Schilger reference would not work to secure the rebar with concrete as the present invention does. Also, FIG. 1 of the Schilger reference has lugs 15 that create openings in the top wall. If used with the present invention, the insulation gets full of concrete and compromise its effectiveness. Also, lugs 15 in the Schilger reference compromise the amount of places where rebar members can be placed because the rebars would have to be maneuvered around the lugs. Moreover, rebar members in the Schilger reference are mounted directly on the top wall without any clearance to pour concrete and further secure them to the beam. The alternative of mounting the rebars to the lugs is equally ineffective because there is still no clearance and the places where rebars can be mounted are limited. Moreover, it would not be obvious in light of Shilger to one of ordinary skill in the art to configure the attachment flanges inwardly to create a channel wherein concrete or cement can be poured while also having throughholes to further secure the rebar members using tie wraps. This is not taught or rendered obvious by any of the related references. Also, the ears 26 of Schilger are bent to hold drywall not to coact with concrete as the present invention does.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a device that provides a flush engagement to the insulating material thereby allowing more surface area to hold the insulating material in place and pressing it securely in place.

Another object of this invention is to prevent the device from piercing into the insulating material.

It is another object of this invention to provide a device with attachment means to the rebar above to secure in place the rebar grid used in roofing construction.

It is still another object of the present invention to provide a device that is made of one piece making it more reliable and less cumbersome to install.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
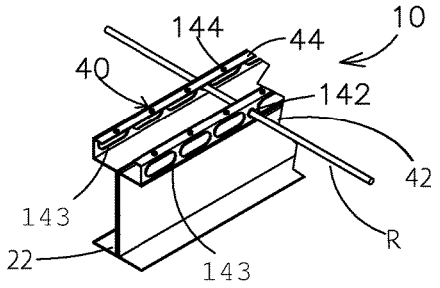
FIG. 1 represents an isometric view of an embodiment of the present device wherein transportation rebar TR is mounted to Z-channel device 10 using throughholes 142.

Referring now to the drawings, where the apparatus, a Z-channel member, is generally referred to with numeral 10, it can be observed that it basically includes a insulation engagement assembly 20 and rebar attachment assembly 40.

Figure 1A:
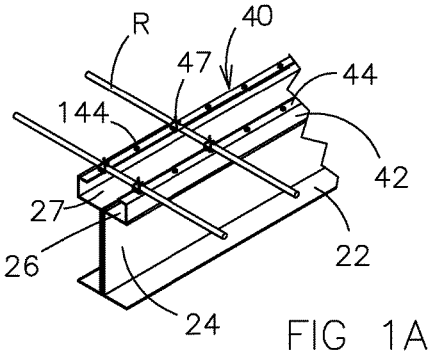
FIG. 1A displays an isometric view of an alternate embodiment of the present invention wherein rebar R is mounted to rebar attachment assembly 40 using tie wraps 47.
Figure 1B:
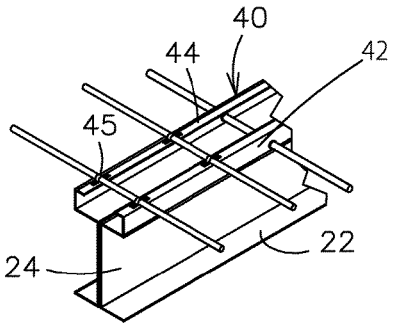
FIG. 1B shows an isometric view of an alternate embodiment of the present invention wherein rebar R is mounted to rebar attachment assembly 40 using clips 45.
Figure 1C:
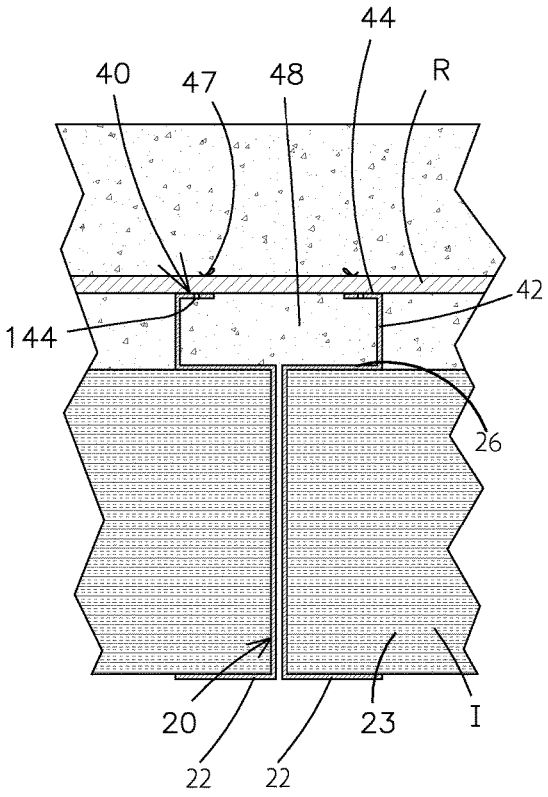
FIG. 1C illustrates a front elevational view of the present invention securing insulating boards I between two Z-channels 10 while rebar R is mounted to rebar attachment flange 44 and concrete is poured over it to create a secure engagement.

As seen in FIGS. 1-1B, insulation engagement assembly 20 includes bottom channel flange 22, side wall 24, and top channel flange 26. Bottom channel flange 22 and top channel flange 26 are kept at a spaced apart and parallel relationship with respect to each other by side wall 24. Bottom channel flange 22, side wall 24, and top channel flange 26 are mounted together to define the space wherein channel 23 travels.

Insulating material I is inserted into channel 23 and are flush with bottom channel flange 22, side wall 24, and top channel flange 26. This flush relationship securely holds insulating material I in place within channel 23.

Figure 4:
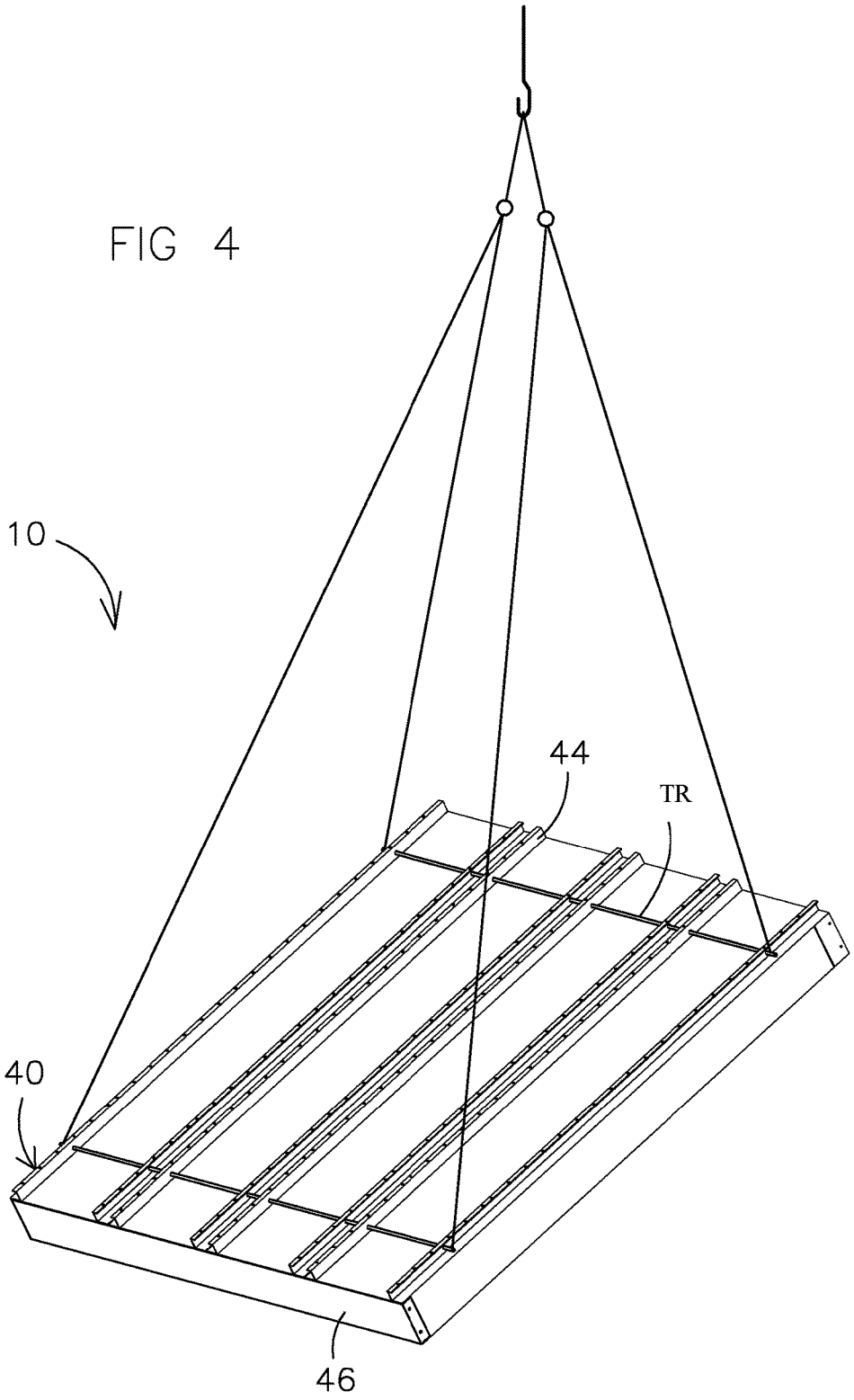
FIG. 4 shows an isometric view of the present invention as part of a pre-assembled roof section being transported by crane using transportation rebar TR.
Figure 5:
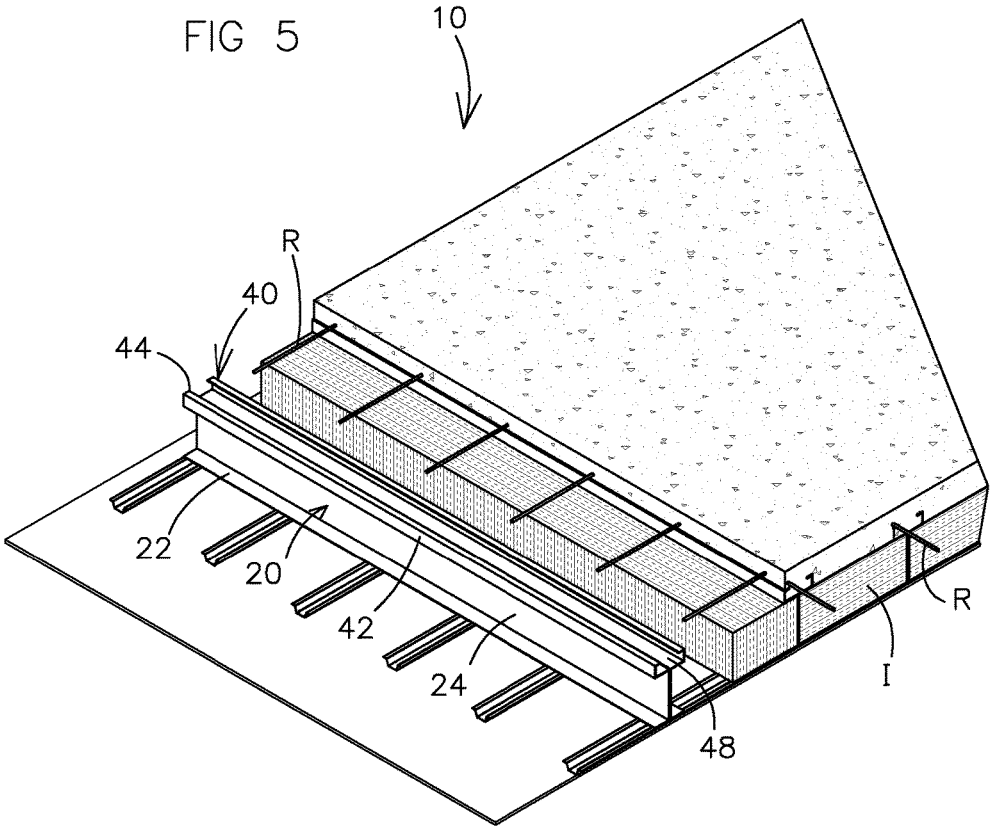
FIG. 5 shows an isometric top partial view of a roof showing the concrete layer poured over rebar member R

FIGS. 1-1B show rebar attachment assembly 40. Rebar attachment assembly 40 includes vertically disposed flange 42 that is perpendicularly mounted above top channel flange 26. Rebar attachment assembly 40 further includes rebar attachment flange 44 that inwardly extends from vertically disposed flange 42 and is perpendicularly mounted thereon. Rebar attachment flange 44 includes a plurality of throughopenings 144 that are used to allow tie wraps 47 to pass through and attach rebar member R to rebar attachment flange 44 as seen in FIG. 1A. In an alternate embodiment shown in FIG. 1B, rebar members R can be secured to rebar attachment flange 44 using clips 45. In another alternate embodiment shown in FIG. 1, vertically disposed flanges 42 include throughholes 142 wherein transportation rebar members TR are inserted and used to transport Z-channel apparatus 10, as shown in FIG. 4.

Additionally, as seen in FIGS. 1-1B, Z-channel 10 includes cavity 48 between vertically disposed flange 42. Cavity 48 is filled with concrete further securing rebar members R to Z-channel member 10. In an alternate embodiment, as seen in FIG. 1 vertically disposed flange 42 includes throughholes 143 which allow concrete to pass into cavity 48 and connect with concrete on opposite sides of vertically disposed flanges 42, thereby creating a more secure engagement by preventing fatigue prone areas caused by the interruption of the concrete.

Figure 2:
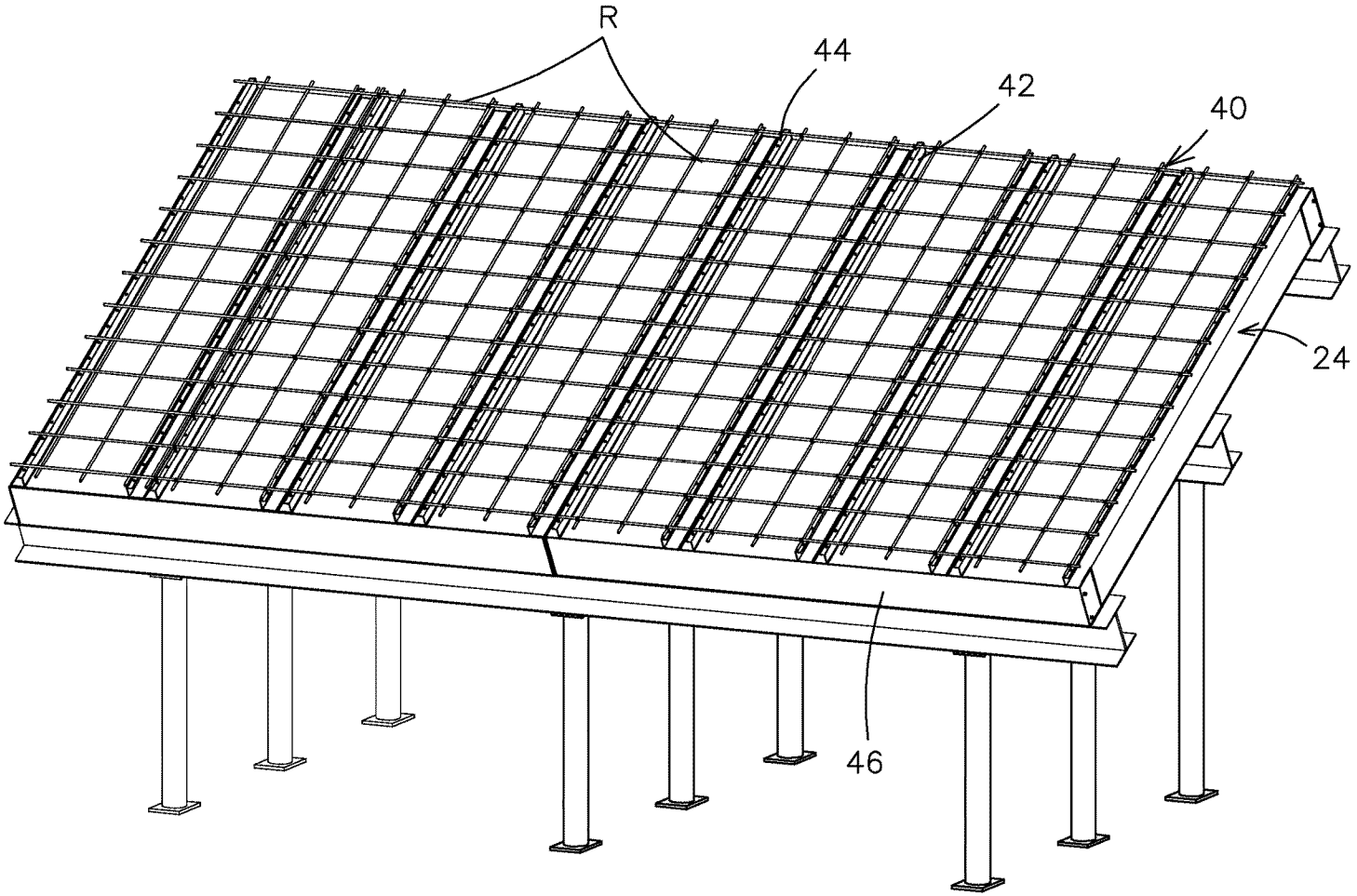
FIG. 2 is an isometric view of a roof with forms showing a grid made of rebar R mounted to a plurality of Z-channels 10 before concrete has been poured. Steel plates 46 can be seen securing the distal ends of insulating boards I.
Figure 2A:
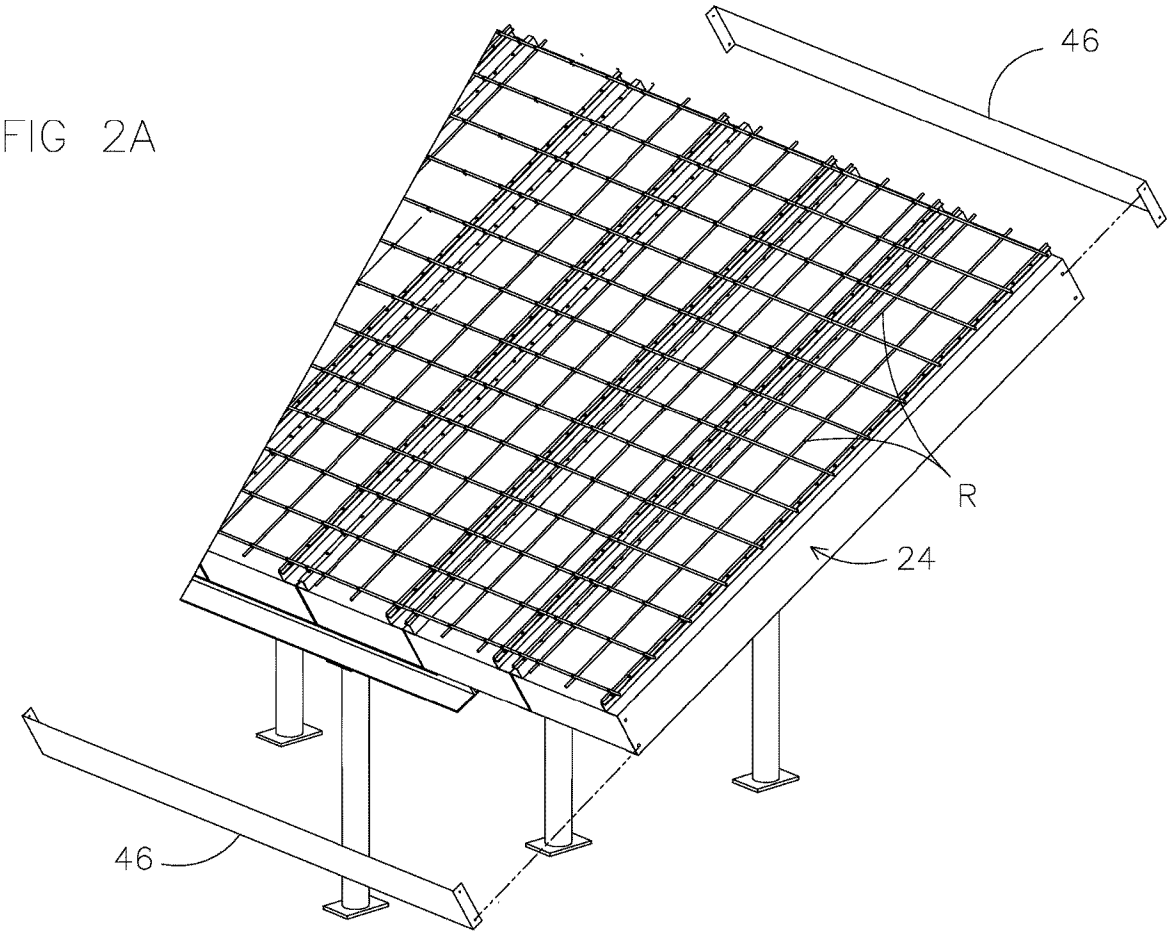
FIG. 2A illustrates an alternate embodiment showing a partial isometric view of a roof showing the grid made of rebars R mounted to a plurality of Z-channels 10 before concrete has been poured. Plates 46 can be seen further securing the insulation boards I within the roof.
Figure 2B:
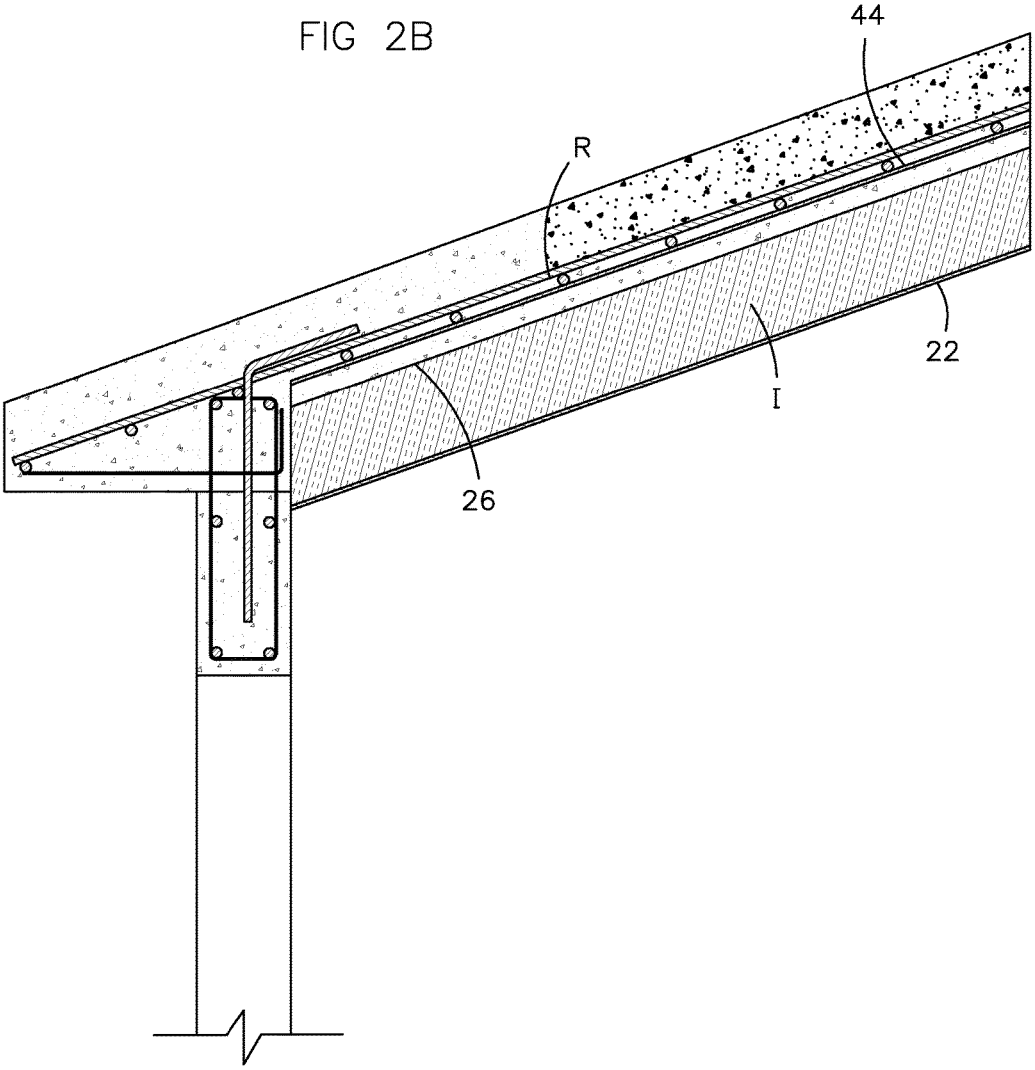
FIG. 2B is a cross-sectional elevation of a portion of the roof after being poured engaging rebar member R and insulating boards I in place.
Figure 3:
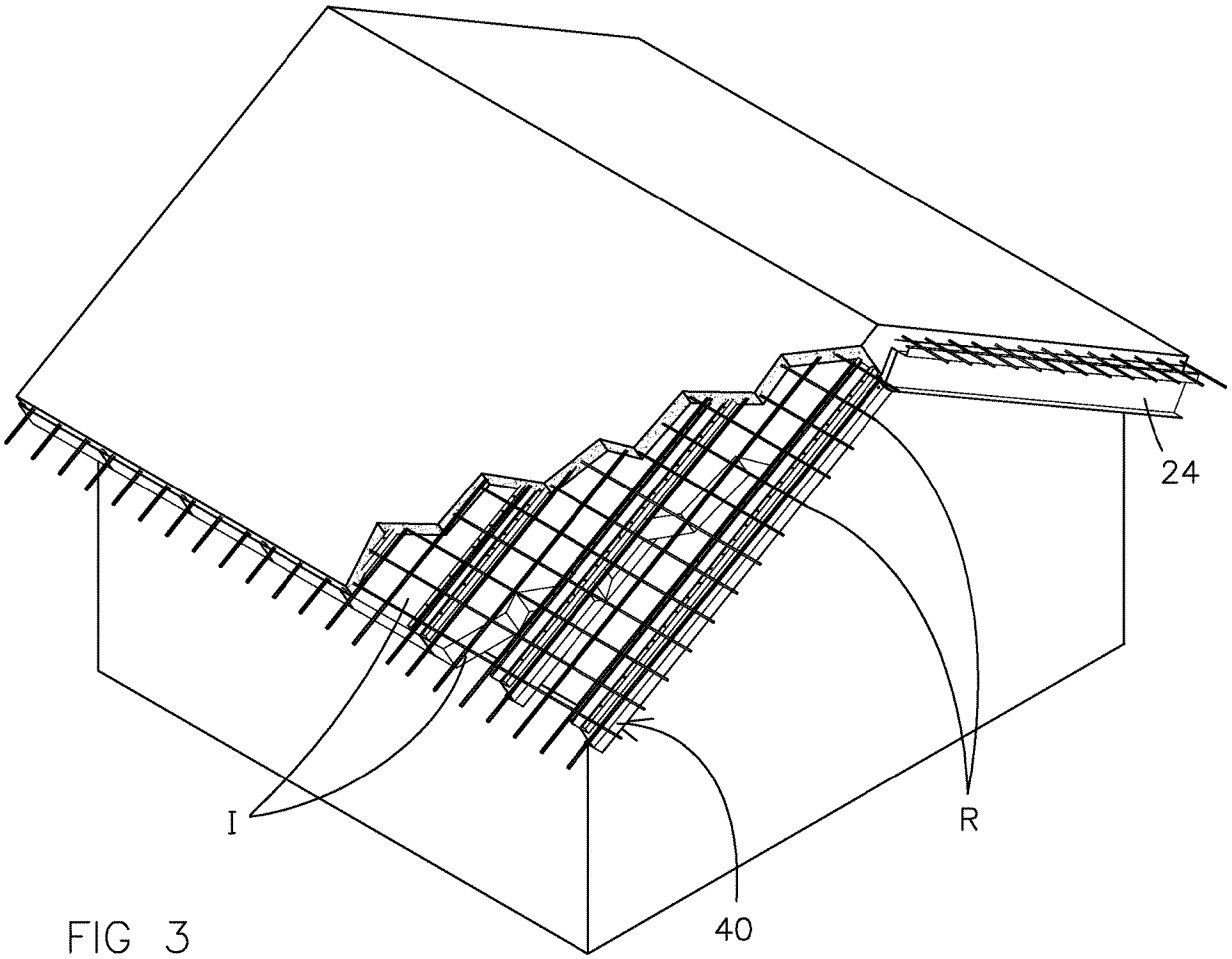
FIG. 3 is an isometric view of a roof with a partial cross-section showing the grid made of rebar R secured to the present invention. A partial view of insulation boards I can also be seen secured by Z-channel devices 10.
Figure 6:
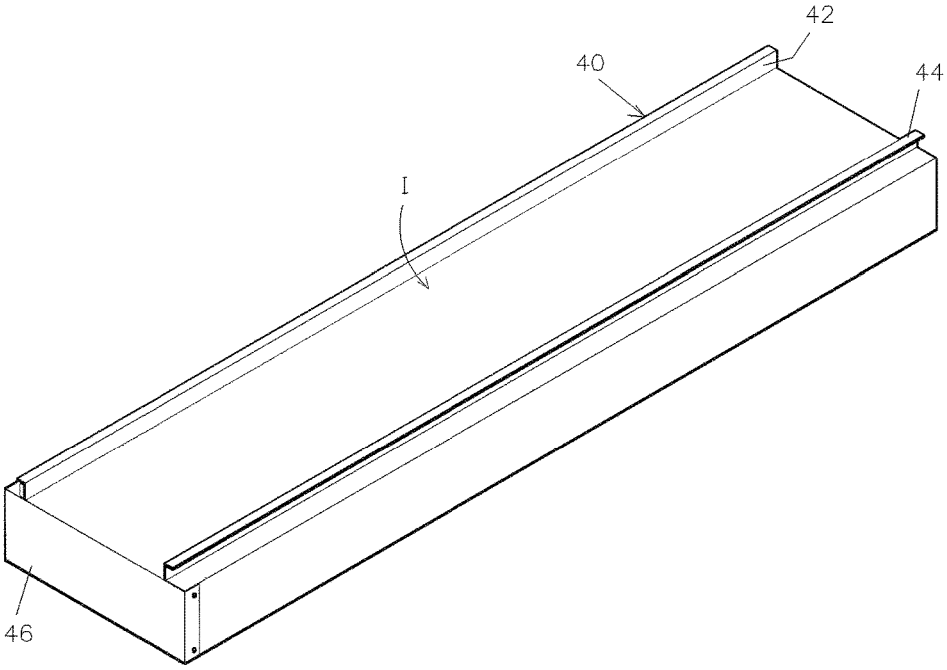
FIG. 6 shows an isometric view of device 10 securing one insulation board I on both longitudinal sides. The shorter sides of insulation board I is being secured by plates 46.

The method of assembling the concrete roof using the apparatus or Z-channel includes the following steps.

a) pre-cut the insulating boards to a desired length depending on the size of the roof;
b) pre-cut the apparatus or Z-channel depending on the size of the roof;
c) position one Z-channel on one side of the insulating board I so that an edge of the insulating board is partially housed within channel 23 and flush against bottom channel flange 22, side wall 24, and top channel flange 26. Position a second Z-channel in the same way on the opposite side of insulating material I
d) as seen in FIG. 6, steel plates 46 are then used to cover the shorter ends of insulating board I perpendicular to the longer ends that were covered by the Z-channels in the previous step;
e) repeat the above steps for each insulating board I to be placed in the roof (in a preferred embodiment, shown in FIG. 2A, each steel plate 46 can be used to cover the shorter ends of multiple insulating boards I put together).

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus used in concrete roof construction, comprising:

A) two C-channel beams each having an elongated bottom wall and an elongated coextensive top wall kept at a parallel and spaced apart relationship with respect to each other and each beam further including a side wall perpendicularly mounted to their respective bottom and top walls, said side walls being abuttingly disposed with respect to each other and defining a channel for each beam, whereby each of said channels have cooperative dimensions to partially house the edges of an insulating board, substantially flush with the bottom flange;

B) a rebar attachment assembly having two elongated attachment walls continuous through the entire length of the beam and mounted substantially perpendicular to said top walls and kept at a substantially parallel and spaced apart relationship with respect to each other further including each an inwardly disposed attachment flange extending along the entire length of said beam and substantially perpendicularly from said attachments walls, said inwardly disposed attachment flanges being uninterrupted and extending towards each other a predetermined distance to define a longitudinally extending cavity between said attachment flanges, attachments walls and top walls for receiving a predetermined amount of concrete or cement, and said attachment flanges having a width and include a plurality of through holes at predetermined distances from each other, said through holes are centrally located with respect to said width of said attachment flanges so that part of the attachment flanges longitudinally extend along both sides of said through holes; and C) a plurality of rebar members defining a rebar grid mounted to said rebar attachment assembly with a corresponding plurality of tie wraps cooperatively mounted to said attachment flanges through said through holes to secure said rebar members in place, said cavity extending along the entire length of the beam to receive said cement or concrete to further secure said rebar members to said rebar attachment assembly with a slab of concrete or cement poured over said insulating boards and over the top of said attachment flanges, thereby securing the rebar members in the cavity.

2. An apparatus used in concrete roof construction, comprising:

A) two C-channel beams each having an elongated bottom wall and an elongated coextensive top wall kept at a parallel and spaced apart relationship with respect to each other an each beam further including a side wall perpendicularly mounted to their respective bottom and top walls, said side walls being abuttingly disposed with respect to each other and defining a channel for each beam, whereby each of said channels have cooperative dimensions to partially house the edges of an insulating board, substantially flush with the bottom flange;

B) a rebar attachment assembly having two elongated attachment wall continuous through the entire length of the beam and mounted substantially perpendicular to said top walls and kept at a substantially parallel and spaced apart relationship with respect to each other further including each an inwardly disposed attachment flange extending along the entire length of said beam and substantially perpendicularly from said attachments walls, said inwardly disposed attachment flanges being uninterrupted and extending towards each other a predetermined distance to define a longitudinally extending cavity between said attachment flanges, attachments walls and top walls for receiving a predetermined amount of concrete or cement, and said attachment walls include a plurality of through holes at predetermined distances from each other; and C) a plurality of rebar members defining a rebar grid mounted to said rebar attachment assembly and a plurality of said rebar members passing through said through holes.

* * * * *